US006397129B1

(12) United States Patent
Lanoix et al.

(10) Patent No.: US 6,397,129 B1
(45) Date of Patent: May 28, 2002

(54) COMFORT MONITORING SYSTEM AND METHOD FOR TILTING TRAINS

(75) Inventors: Daniel Lanoix, Longueuil; Benoit Racicot, St-Bruno, both of (CA)

(73) Assignee: Bombardier Inc., West Montreal (CA)

( * ) Notice: Subject to any disclaimer, the term of this patent is extended or adjusted under 35 U.S.C. 154(b) by 0 days.

(21) Appl. No.: 09/633,069

(22) Filed: Aug. 4, 2000

Related U.S. Application Data

(60) Provisional application No. 60/162,785, filed on Nov. 1, 1999.

(51) Int. Cl.[7] ..... G05D 1/00

(52) U.S. Cl. ..... 701/19; 701/37; 701/38; 701/48; 701/72; 105/199.2

(58) Field of Search ..... 701/19, 20, 35, 701/37, 38, 48, 72; 105/199.2, 164

(56) References Cited

U.S. PATENT DOCUMENTS

| | | | | |
|---|---|---|---|---|
| 3,572,747 A | | 3/1971 | Pollinger et al. | 280/124 |
| 3,683,818 A | | 8/1972 | Meir et al. | 105/199 A |
| 3,789,769 A | | 2/1974 | Strohmer et al. | 105/164 |
| 3,844,225 A | | 10/1974 | Di Majo | 105/164 |
| 3,970,009 A | | 7/1976 | Schultz | 105/164 |
| 4,267,736 A | | 5/1981 | Westbeck | 74/5.22 |
| 4,440,093 A | | 4/1984 | Kakehi et al. | 105/164 |
| 4,715,289 A | | 12/1987 | Okamoto et al. | 105/199.2 |
| 5,103,396 A | | 4/1992 | Hiwatashi et al. | 701/48 |
| 5,170,716 A | | 12/1992 | Durand et al. | 105/199.2 |
| 5,285,729 A | | 2/1994 | Bangtsson et al. | 105/199.2 |
| 5,295,443 A | | 3/1994 | Bangtsson et al. | 105/199.2 |
| 5,331,903 A | | 7/1994 | Elia | 105/199.2 |
| 5,346,242 A | | 9/1994 | Karnopp | 280/707 |
| 5,430,647 A | | 7/1995 | Raad et al. | 701/48 |
| 5,787,815 A | * | 8/1998 | Andersson et al. | 105/199.2 |
| 5,809,448 A | | 9/1998 | Gimenez et al. | 701/213 |

FOREIGN PATENT DOCUMENTS

| | | |
|---|---|---|
| DE | 049957 | 8/1964 |
| DE | 1933893 | 2/1970 |
| DE | 3935740 | 5/1991 |
| EP | 0 713816 | 5/1996 |
| EP | 0 557893 | 11/1996 |
| EP | 0 808758 | 11/1997 |
| GB | 1 379059 | 1/1975 |

OTHER PUBLICATIONS

International Search Report dated Mar. 27, 2001, which caused the three references to be cited in related PCT Application No. PCT/CA00/01303.

A Bord Du Nouveau Train Pendulaire Italien, La view du Rail & des transports, N 2539, Mar. 27, 1996, p. 11.

Talbot Tilt System Prepares For Trails, Passenger Rail, Dec. 1995/Jan. 1996, pp. 35, 39–42.

Fiat Dominates Tilting Train Market, International Railway Journal, Dec. 1995, pp. 22–23.

New Tilting Mechanisms Developed, International Railway Journal, Dec. 1995, pp. 26–27.

Perseverance Brings Commercial Reward, International Railway Journal, Dec. 1992, pp. 23, 25, 28.

The Development of Advanced High Speed Vehicles in Sweden, Proc. Instn. Mech. Engrs., vol. 198D, No. 15, 1984, by E. Andersson et al., pp. 229–237.

(List continued on next page.)

*Primary Examiner*—William A. Cuchlinski, Jr.
*Assistant Examiner*—Arthur D. Donnelly
(74) *Attorney, Agent, or Firm*—Pillsbury Winthrop LLP

(57) ABSTRACT

Using a lateral acceleration measurement to which passengers are subjected in a passenger car of a tilting train, a comparison to an acceptable level of lateral acceleration is made. As a result of this comparison, the control of the tilting system is altered. The tilting system can be shut down automatically, on a car-to-car basis, or manually using the tilting system controller. Passenger comfort will be increased since detection of abnormal operation of the tilting system will be performed rapidly.

35 Claims, 7 Drawing Sheets

OTHER PUBLICATIONS

Swedish Body–Tilting Electric Set for Very High Speed on Severly–Curved Main–Lines, Rail Engineering International, May/Sep. 1982.
Computers Take Over on X2, Railway Gazette International, Jul. 1987, by Lennart Sandberg, pp. 447–449.
Further Developments with the Italian Solution on Tilting Trains, World Congress on Railway Research Conference 1996, by C. Casini et al., pp. 371–380.
Bischheim: Le TGV Pendulaire Pret Pour Les Essais, La vie du Rail & des transports, N. 2531, Jan. 28, 1998, by Alain Wairt, p. 10.
Tilting Trains: How do they work? The Railway Magazine, Aug. 1997, pp. 56–61.
QR to Start Service in 1998; International Railway Journal, Aug. 1997, pp. 15–16.
Tilt System for Amtrak High Speed Trainsets, IEEE/ASME Conference, Mar. 18–20, 1997, by Helmut Kolig et al., pp. 59–64.
Axis: Quand La RTG Devient Pendulaire, La view du Rail & des transports, Jun. 3, 1998, by Alain Wairt, p. 6.
Axis: Le Demonstrateur Pendulaire De Bombardier, Revue Generale des Chemins der Fer, Jan., 1999, pp. 57–58.
Bullet Train for America—Popular Mechanics, Mar. 1993, by Gregory T. Pope, printed on 99–11–23 from web site at www.popularmechanics.com/popmech/sci/9303STTRAM.html.
American Flyer—Popular Mechanics, Nov. 1996, by Jim Wilson, pp. 56–59.
Bombardier's New Generation Tilting System, IEEE Canadian Review, Spring/Summer 1995, by Daniel Lanoix, pp. 11–14.
French Start Tests with New Tilting TGV Bogie, International Railway Journal, Jul. 1999, by Laurent Hazard, pp. 25–26.
Geoffrey Freeman Allen, Introduction—Railway Technology International, Oct., 1995, pp. 7–8.
The Swing Active Body Tilt System—Railway Technology International, Oct., 1995, pp. 61–62.
The Active Tilting System SIG–SWING, SIG Brochure.
All Aboard for High–Speed Rail, Mechanical Engineering, Sep. 1996, by David Herman, pp. 94–97.
Le Difficile Avenment Du, <Cisalpino>, Rail Passion, N Jl 10, 1996, by Philippe Herisse, pp. 46–48.
Quatre Pistes Pour L'Apres Grande Vitesse, La vie du Rail & des transports, N 2541, Apr. 10, 1996, by Dumont, Francois et al., pp. 14–18.

* cited by examiner

FIG. 3
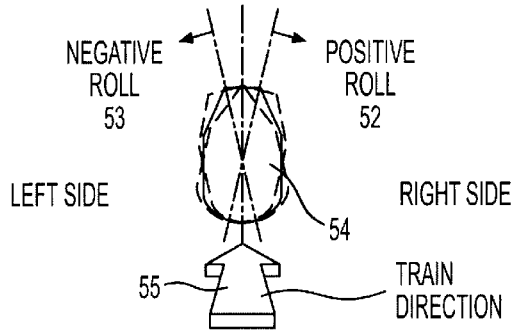
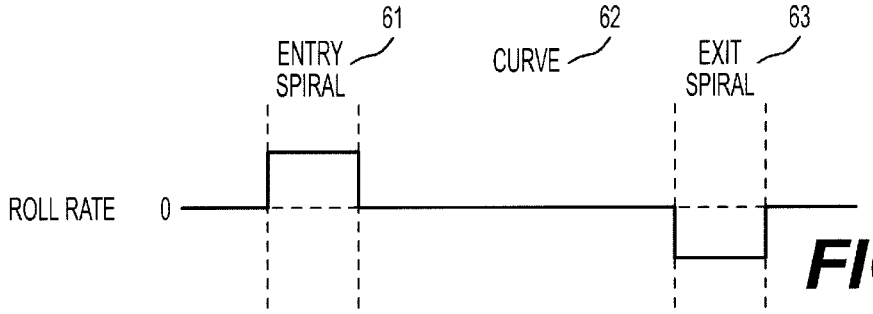
FIG. 4a
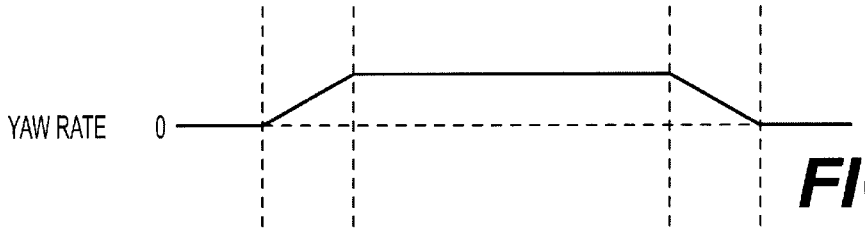
FIG. 4b
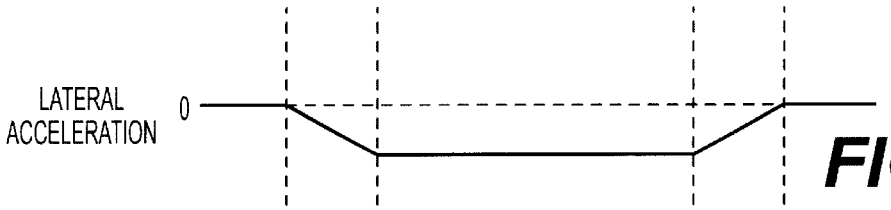
FIG. 4c

69
ENTRY SPIRAL
70
CURVE
71
EXIT SPIRAL
74
0
LATERAL ACCELERATION (BOGIE LEVEL)

0
FILTERED LATERAL ACCELERATION (MASTER CONTROLLER)

72
73
0
RESIDUAL LATERAL ACCELERATION (PASSENGER CAR FLOOR)

COMFORT MONITORING SYSTEM AND METHOD FOR TILTING TRAINS

This Appln claims benefit of Prov. No. 60/162,785, filed Nov. 1, 1999.

FIELD OF THE INVENTION

The invention relates to monitoring units in tilting systems used in railway vehicles to control longitudinal roll motion mechanisms in order to increase passenger comfort. In particular, knowing the speed, the lateral acceleration and the tilting angle command from the tilting system, the invention enforces the comfortable operation of a train tilting system.

BACKGROUND OF THE INVENTION

It is becoming necessary to rethink the actual train infrastructure: travel time must be reduced to compete with airlines, existing tracks must be shared with freight trains, and land or budget constraints often prohibit the construction of dedicated high-speed tracks. The only solution is tilt technology. The need for tilting control systems was discussed in the November 1996 issue of *Popular Mechanics* magazine, in an article entitled "American Flyer", as being a solution to improve passenger comfort during train rides. High-speed tilting trains require finely tuned mechanisms to ensure passenger comfort.

A "tilting system" is a combination of electrical, electronic and hydraulic components that control a railway car's longitudinal roll motion mechanism. It is used in passenger trains in order to increase passenger comfort that is affected by centrifugal acceleration in curves. Centrifugal acceleration is a serious limiting factor to the maximum cruising speed of a passenger train.

The maximum speed allowed in curves is limited by three factors: the maximum tilt angle of the car (usually between 5° and 9°), the maximum steady state residual lateral acceleration and the forces applied to the tracks by the non-tilting locomotive, which is almost two times heavier than a passenger car. The dynamic wheel/rail forces are almost identical for both a tilting and a non-tilting car at a given speed. All forces vary with the square of the speed.

Railroad curves are generally designed in order to compensate for a portion of the centrifugal acceleration by means of track super-elevation (or cant angle) that will force the car body to tilt along its roll axis. Properly oriented this tilt angle creates a gravitational component vector reducing the centrifugal force felt by the passengers in curves. The maximum super-elevation angle is typically 6°. On conventional tracks, the presence of heavy freight trains is one source of limitation for the maximal super-elevation. There is a maximal force that the inner rail can tolerate when the heaviest vehicle allowed to roll on The said track is immobilized in the curve.

Considering this design criteria, one can demonstrate that most passenger railway corridors in North America and Europe presently lack the proper amount of curve super-elevation that would allow the operation of high-speed trains without seriously compromising passenger comfort. Since modifications to conventional tracks are too costly and since speed and passenger comfort are the key to the survival of the passenger train industry, the solution resides in tilting systems.

Passenger cars equipped with an active roll motion mechanism, also called a "tilting system" can overcome this cant deficiency problem by giving the proper amount of roll to the car body in order to compensate for the lack of curve super-elevation. Passenger comfort is then improved and high-speed operation becomes possible on most existing railway corridors.

Tilting the body of a rail passenger car during curve negotiation offers the possibility of increasing the speed of a trainset in a curve without exceeding the maximum allowed steady state lateral acceleration felt by the passengers. Typically, the lateral acceleration due to centrifugal force should be lower than 1 m/sec$^2$ (i.e. lower than 0.1 g). This tilting feature reduces the overall traveling time without requiring track modification. Moreover, an effective tilting system greatly improves the passenger ride comfort during curve entry and exit by minimizing the transient accelerations.

Usually, the tilting mechanism only cancels 70% of the centrifugal force. A March 1993 article in *Popular Mechanics* magazine entitled "Bullet Train for America" explains the effect of the tilting system on the passenger: "Standing up, a rider notices the floor push gently against the left foot, as the view out the window pitches skyward". The reason why the centrifugal acceleration is not compensated 100% is because neural signals from the eye would clash with those from the inner ear of the passengers, which senses no change at all and would cause motion sickness.

The tilting system is activated by the locomotive engineer before the train undertakes a run. A cab indicator informs the engineer of the tilting system status. When the system is activated, the locomotive engineer can operate the train at higher speeds. If the tilting system is deactivated, the train engineer must return to conventional speed in all curves for passenger comfort purposes. The difference between tilting and conventional speeds in high-speed curves is typically 35 km/h.

When passengers travel on such tilting trains, their comfort must be guaranteed at all times. The consequences of a failure to compensate the lateral acceleration correctly are immediate. Miscalculations of the proper compensation or erroneous actuation could result in increased motion sickness felt at the passenger level and, potentially, lost of balance. The generation of a tilt angle command must handle the worst-case scenario and, in addition, means to cancel the tilting command must be provided.

Tilting of the car is accomplished by a servo-valve controlling the hydraulic mechanism, which in turn tilts the car. The tilting control system responds to the output of a low-pass filtered inertial sensing system. Within a curve, cant deficiency is stable and passengers experience the cant improved by the tilting system. But delays introduced by the low-pass filtering could lead the passengers to experience a discomfort twice in a curve: at entry and exit. At these locations, the outward acceleration felt by the passengers is compounded by the acceleration of the tilt system, i.e. the outward acceleration due to the curve is added to the outward acceleration due to the roll movement of the compensating tilting. The reaction time and the accuracy of the control system are therefore critical. It is important for the control system to notice malfunctions and react rapidly and adequately.

If the tilting system is not closely monitored, various degrees of uncomfortable situations can occur, including passenger loss of balance and beverage spilling.

Similar uncomfortable situations would also occur when trains tilt in straight track segments.

OBJECTS OF THE INVENTION

It is the object of the present invention to provide a method which dynamically adjusts the threshold (or acceptable limit) value for the detection of malfunctions. The decision to generate an alarm signal will automatically arise as a function of the input signal polarities and absolute values. According to a further object of the present invention, passenger comfort will be increased since detection of abnormal operation of the tilting system will be performed rapidly. Finally, one further object of the present invention is to provide a method and system which dynamically adjust the threshold value to measure the performance of the tilting system.

SUMMARY OF THE INVENTION

The present invention is directed to a method that satisfies the need for an early detection of faulty tilting control system behavior due to failures. It allows fast and reliable shutdown capability of a malfunctioning tilting control system.

A failure in a part of the tilting system, which can lead to passenger discomfort, can be identified when one of the following is detected:

1) There is an inverse tilting command in a curve requiring tilting, i.e. the train tilts on the wrong side;
2) There is a tilting command in a straight (tangent) track segment, i.e. the train is going in a straight line but is tilting; and
3) The tilting command in a curve is properly oriented, but not sufficient to meet comfort criteria, i.e. the cant angle is too small and the train does not tilt enough.

The occurrence of case 1 or 2 denotes an important malfunction of the tilting system, which could greatly affect passenger comfort. Therefore, the detection of these conditions shall be performed according to stringent requirements.

On the other hand, since some amount of residual lateral acceleration in a curve is expected for passenger comfort, the occurrence of case 3 could be caused, for example, by a wrong control parameter adjustment, e.g. the ratio of cant deficiency compensation. In this case, the acceptable residual acceleration criterion is different than in cases 1 and 2. An over-speed situation in a curve could also lead to case 3, since there is a limit to the maximum tilting angle achievable.

In order to detect a situation where passenger comfort could be affected, an accelerometer can be installed on the passenger car floor level to measure lateral acceleration, which can be compared to a static threshold value. In this case, the threshold would have to be adjusted to a small value in order to obtain a prompt detection for cases 1 and 2. However, the value of this threshold could be too restrictive for normal tilt operation, and would cause false anomalous detection.

To generate an alarm when malfunctions or poor performance occur in a train tilting system, according to one broad aspect of the invention, the lateral acceleration to which passengers are subjected in a passenger car is measured. It is compared to an acceptable level of lateral acceleration and this comparison alters the control of the tilting system. This altering can be a trigger for a cab indication, a means for shutting down the tilting system or another alarm output system. This monitoring can be done on a car-by-car basis.

According to a preferred feature of the invention, the polarities of the lateral acceleration of a passenger car and the tilting command for that passenger car are compared to determine a polarity check flag. Using this polarity check flag, the absolute value of the tilting command, the train speed and the polarity of the lateral acceleration, a lateral acceleration limit is produced. This lateral acceleration limit can be one of four limit lines, a constant value, a function of speed or chosen via a comparison table. If the lateral acceleration is greater than the lateral acceleration limit for a pre-determined period of time, an alarm is produced.

According to another broad aspect of the invention, a system for monitoring malfunctions is composed of means to measure the lateral acceleration, a comparator for comparing the lateral acceleration with a limit for the lateral acceleration and means to alter the control of the tilting system. According to another preferred feature of the invention, a system for monitoring malfunctions is composed of two polarity detectors, an absolute value detector, a comparator for the polarities of the lateral acceleration and the tilting command, a threshold function that generates the limit for the lateral acceleration, another comparator for comparing the lateral acceleration with the limit and a persistency check that outputs an alarm if the tilting system is malfunctioning for a period of time longer than a pre-determined delay.

BRIEF DESCRIPTION OF THE DRAWINGS

These and other features, aspects and advantages of the present invention will become better understood with regard to the following description and accompanying drawings wherein:

FIG. 3 is a view from the back of a car showing the convention for signal polarity of the-roll rate;

FIG. 4 is the ideal dynamic behavior (roll rate, yaw rate and lateral acceleration) of a body traveling on a railway;

DETAILED DESCRIPTION OF THE PREFERRED EMBODIMENT

Figure 1:
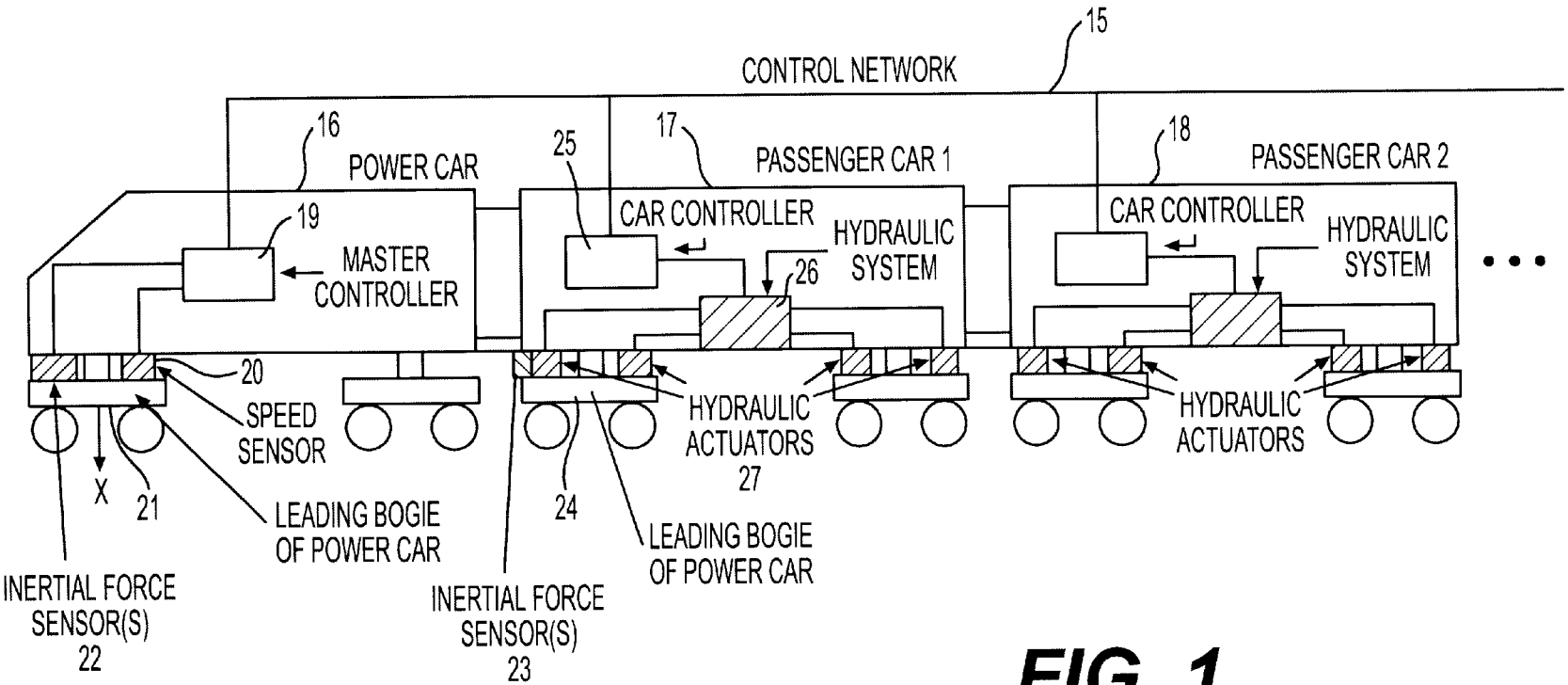
FIG. 1 shows a passenger train comprising a locomotive and two passenger cars and illustrates the main components of the tilting system and their location n atypical trainset.

FIG. 1 illustrates the main components of the tilting system and their location on a typical trainset comprising a power car or locomotive 16, a first passenger car 17, a second passenger car 18 and so on. Inertial sensors such as roll rate sensor and yaw rate gyroscope and lateral acceleration 22 and a speed sensor 20 are located on the leading truck 21 of the power car to allow advanced detection of the signals required to operate the system. Inertial force sensors 23 can also be located on the leading bogie 24 of the passenger car that is being controlled. The master controller 19 receives signals from sensors 20, 22, 23, detects curves and filters the sensor signals. It can compute appropriate tilting angles for all the passenger cars 17, 18, etc. as a function of speed and car position and transmit this information to car controllers 25 via the control network 15, or simply send the filtered sensor signal to the car controllers 25. The car controllers 25 perform closed-loop control of the hydraulic actuators 27, which give the roll motion to the car body. The actuators 27 can also be of other type, such as electric.

The system architecture also allows the power car 16 to tilt, if the latter is equipped with appropriate actuating components 27. On other types of tilting system architectures, all the sensing means can be located in each car in the train to allow for independent control and supervision of the tilting system.

Figure 2:
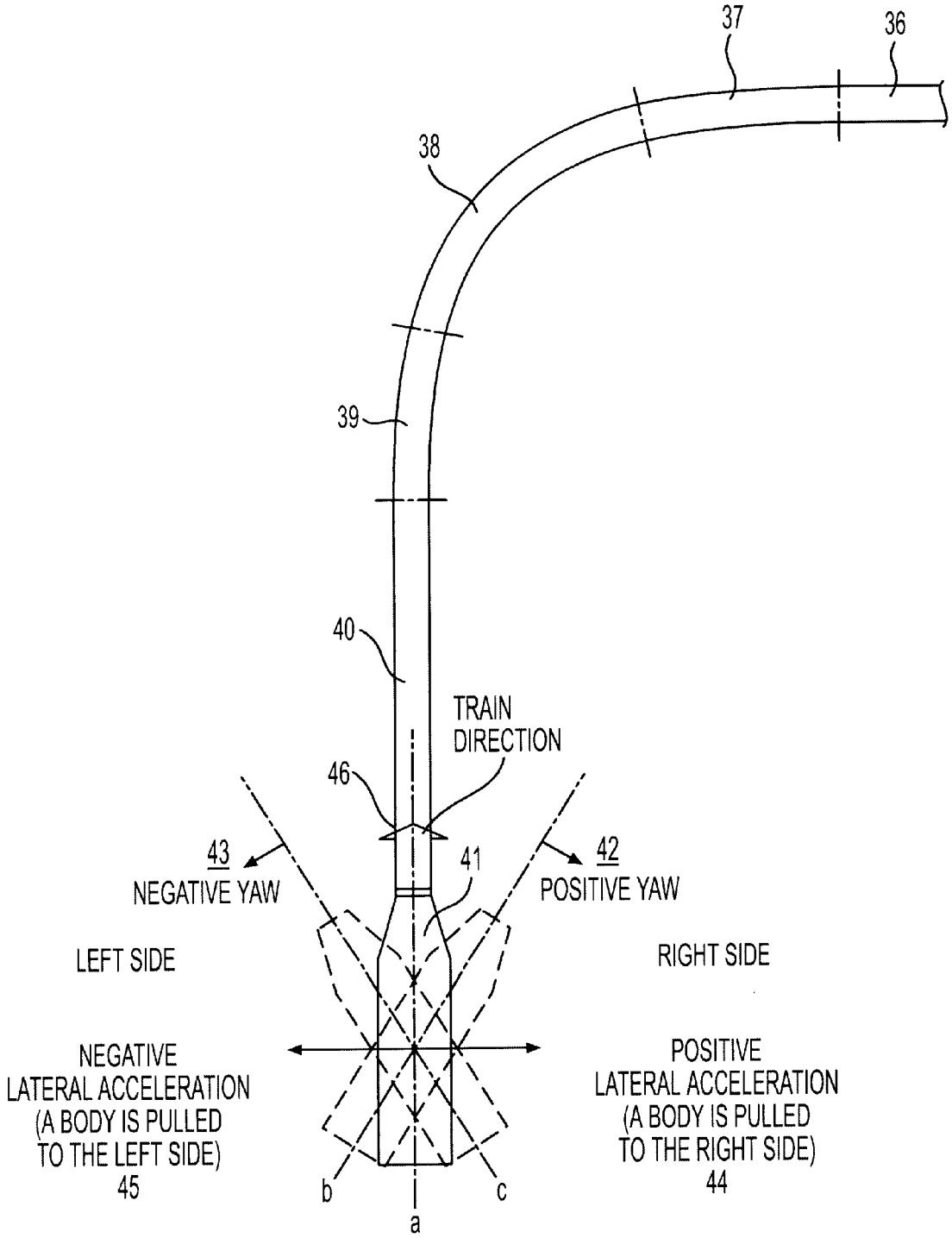
FIG. 2 is an aerial view of a car showing the convention for signal polarity of the yaw rate and the lateral acceleration and showing a typical curve with the entry spiral and the exit spiral.

Change in direction of a railway vehicle is induced by the railroad curvature. FIG. 2 shows a typical curve. All railroads are constructed as a sequence of straight track segments and curves. Passages through curves always involve three steps: entry spiral 39, curve 38 and exit spiral 37. The entry spiral 39 is the transition between straight track segment (infinite radius) 40 and the curve 38 per se, which has a constant radius of curvature. The exit spiral 37 is the transition between the curve 38 and the next straight track segment 36.

Also shown on FIG. 2 and FIG. 3 are the conventions for signal polarity. In FIG. 2*a*, the train 41 follows the tracks in a regular direction 46. In FIG 2*b* and 2*c*, the train 41 undergoes a yaw. Also shown in FIG. 2 is the lateral acceleration convention. In FIG. 3, the train 54 is shown going into the page in a typical direction 55; the convention for the roll rate is illustrated. The ideal dynamic behavior of a body traveling on a railway is described in FIG. 4, where the roll rate (FIG. 4*a*), yaw rate (FIG. 4*b*) and lateral acceleration (FIG. 4*c*) are illustrated. These quantities are measurable by inertial sensors and can be used as inputs to a tilting control system. Lateral acceleration is a direct measure of cant deficiency. The effects of entering the entry spiral 61, the curve 62 and the exit spiral 63 with cant deficiency are shown.

Figures 5A, 5B, 5C:
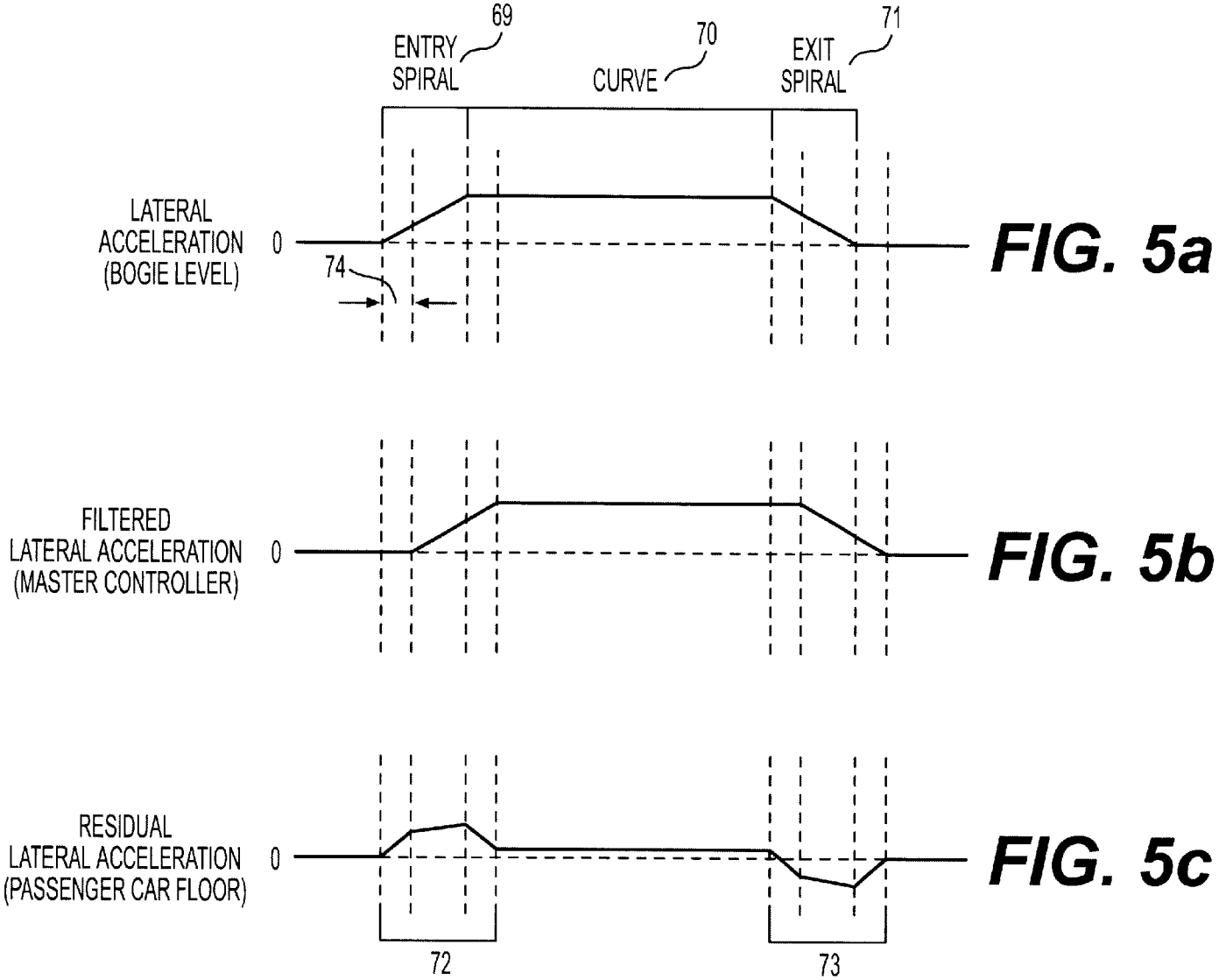
FIG. 5 illustrates the actual response of a tilting system lateral acceleration, filtered lateral acceleration and residual lateral acceleration, where a residual lateral acceleration in curve entry and exit is minimized when the tilting system operates normally.

The dynamic performance of a tilting system can be measured by is behavior in entry and exit spirals, where lateral acceleration (or cant deficiency) can be rapidly increasing. For sake of simplicity, delays associated with the mechanical components of the actuating system have been neglected, so that the lag 74 is only associated with passenger perception, the centrifugal acceleration is usually not fully compensated (FIG. 5*c*).

Figure 6:
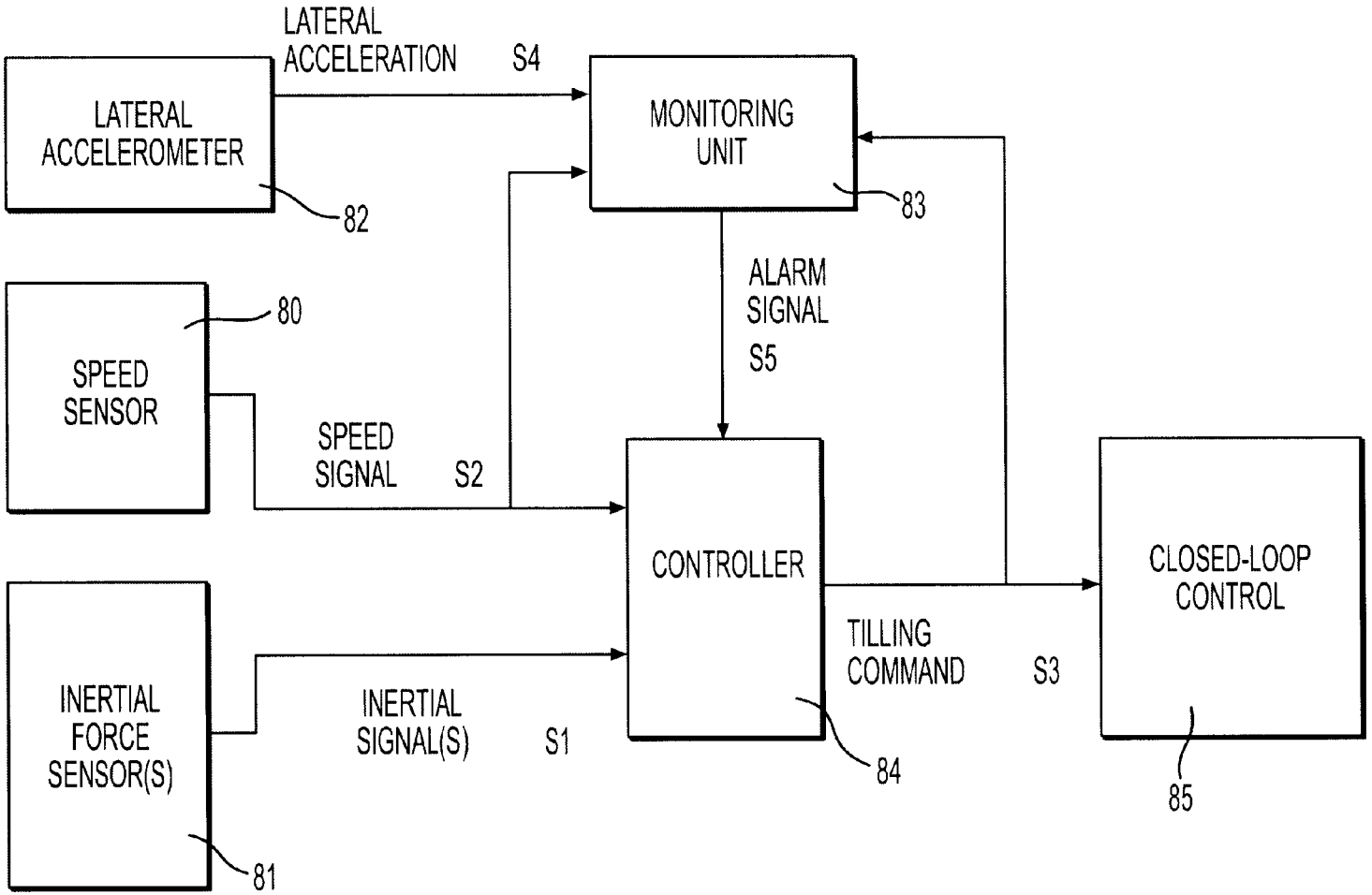
FIG. 6 is a block diagram showing the monitoring unit within its environment.

FIG. 6 presents the monitoring unit, within the context of a tilting system. The latter is typically linked to a set of inertial force sensors 81 installed on the leading bogie of the passenger car 24 or of power car 21, a speed sensing means 80, a controller 84 and a closed-loop control means 85. Both the controller 84 and the closed-loop control means 85 can be located either at the master controller 19 level or at the passenger car controller level 25 via the control network 15. The controller 84 processes inertial signals S1 from the inertial force sensors 81 and speed signal S2 from the speed sensor 80 to generate a tilting angle command S3, sent to the closed-loop control 85. Note that several architectures of tilting systems exist, but this invention only requires the speed signal S2 and the tilting angle command S3 to be available on a passenger car basis. The controller 84 could have an indication of the location of the passenger car with respect to the sensors on the locomotive, to be able to calculate the effective delays for each passenger cars.

An accelerometer 82 installed on the passenger car floor and sensitive to the transversal axis measures the lateral acceleration S4 at any time during the travel. It goes without sating that the accelerometer 82 can be adequately installed in other locations in the passenger car. This accelerometer 82 can be of any type. It is located preferably inside the car so that the suspension of the car cancels part of the high frequency component present at the car bogie level. At the same time, it is located close to the center of rotation of the car to permit an accurate reading of the lateral acceleration of the car, even when tilting. The suspension would act as a filter on the lateral acceleration signal. If the suspension has an inherent mechanical delay, this delay should be taken into account when performing the monitoring of the signals. The monitoring unit 83 performs monitoring on speed S2, tilting command S3 and lateral acceleration S4 and generates an alarm S5. The latter can be used by any appropriate element of the tilting system architecture in order to disable the tilting function and re-center the car in case of an inconsistency between speed S2, tilting command S3 and lateral acceleration at the passenger level S4.

The lateral acceleration signal S4 is preferably damped prior to the monitoring. The filter 97 produces the signal S4', a more accurate estimation of the lateral acceleration experienced by passengers. Typically, lateral acceleration should be contained in the range of 0 to 5 Hz. This additional filtering is used if suspension of the passenger car is insufficient to filter the lateral acceleration signal. Well known techniques can be used to damp the lateral acceleration S4. This filtering caused by filter 97 help reducing vibrations and thus false signals. Indeed, vibrations would cause the persistency check 95 to be partly disabled when vibrations cause the comparator 94 to change state too often when acceleration oscillates over and under the threshold value S9. Also, vibrations could cause fast changes in the threshold function 93 when the acceleration oscillates between positive and negative values.

Figure 7:
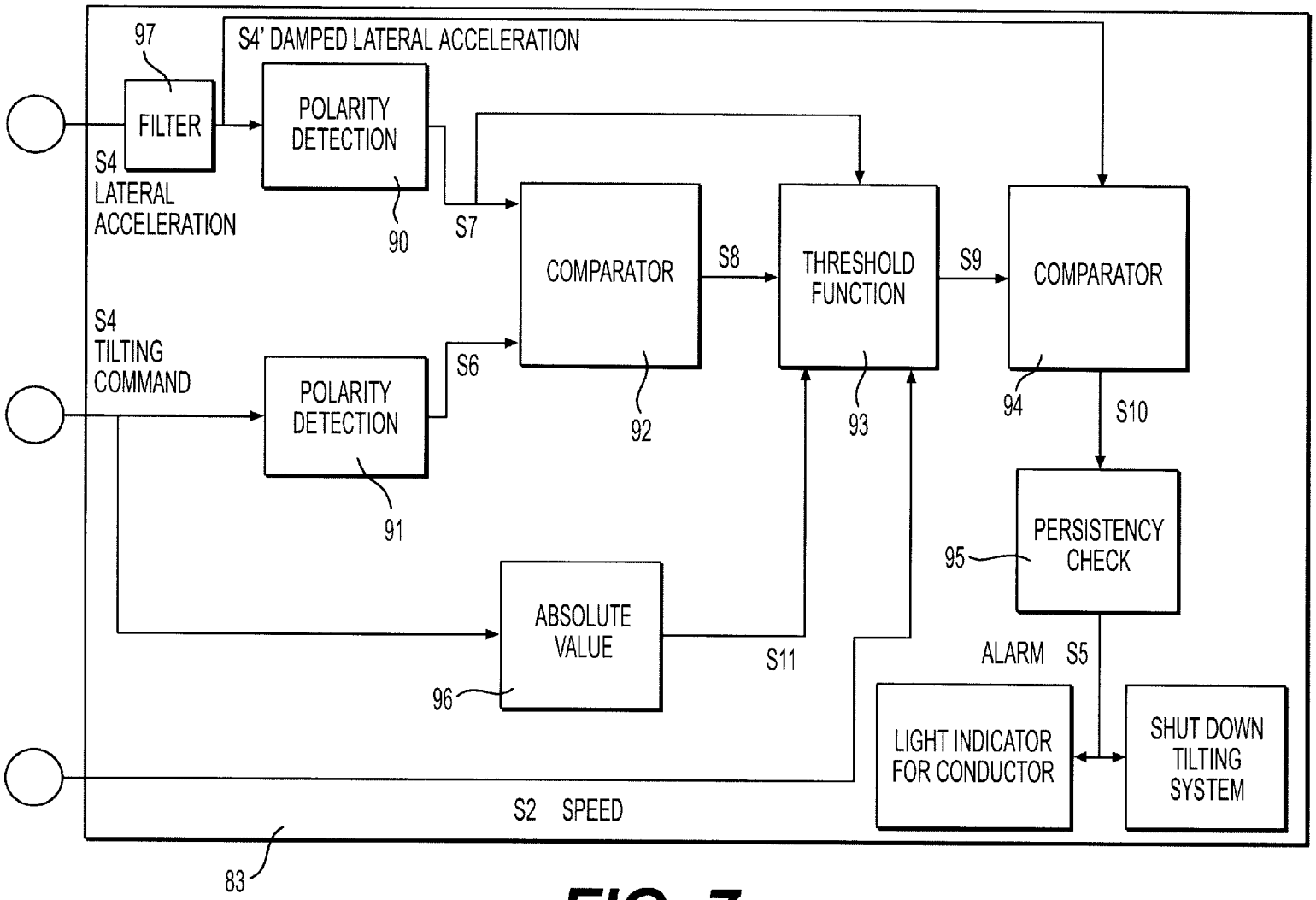
FIG. 7 is a schematic of the monintoring unit.

A detailed presentation of the monitoring unit 83 is presented in FIG. 7. The polarity of lateral acceleration S4' is determined by polarity detector 90, which outputs −1 if lateral acceleration S4' is less than zero or +1 if lateral acceleration S4' is greater than or equal zero. A similar device, second polarity detector 91, outputs a signal S6 that determines the polarity of S3. The polarity of the tilting command S6 and the polarity of the lateral acceleration S7 are compared in comparator 92, to produce a polarity check flag S8 that is positive if both polarities S6 and S7 are negative, positive if both polarities S6 and S7 are positive, and negative otherwise. If the polarity check flag S8 is positive, the situation is such that an acceleration residual is in the same direction as the tilting angle command. In parallel, the absolute value of the tilting command S11 is produced by absolute value determiner 96. The speed S2, the polarity of the lateral acceleration S7, the polarity check flag S8, and the absolute value of the tilting command S11 are fed to a limit determination function 93.

Figure 8:
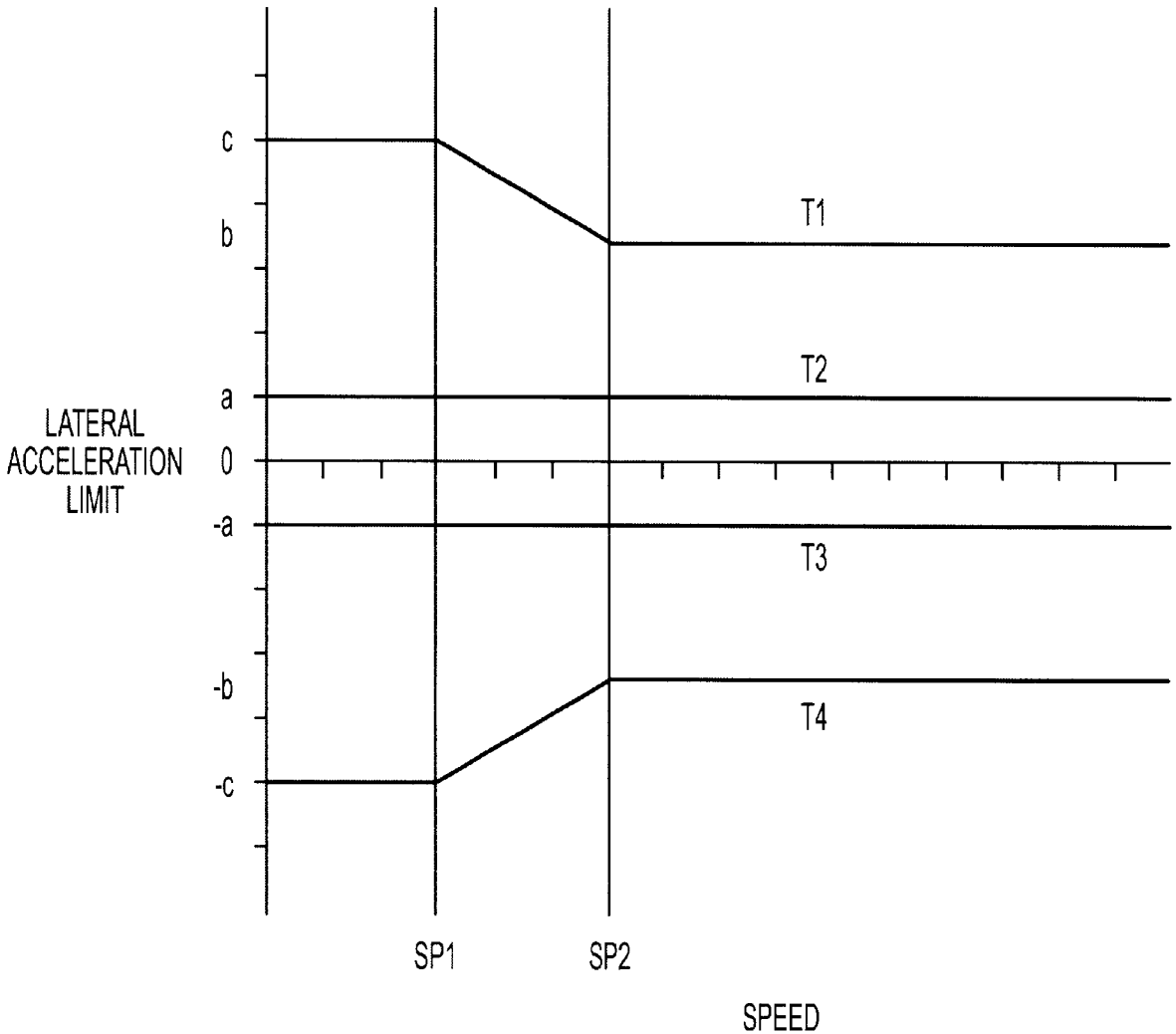
FIG. 8 is an illustration of the limit lines followed by the monitoring unit.

FIG. 8 presents how the limit determination function 93 selects the limit value. A limit line (T1, T2, T3 or T4 ) is first selected according to Table 1. Then, a location on the limit line is found with respect to the speed S2. Note that Limit Line T1 and Limit Line T4 are the only limit lines subjected to give a changing limit value of the lateral acceleration (between b and c and between −c and −b) as a function of speed S2. This is to lake account of the fact that some tilting systems do not apply a uniform compensation of cant deficiency over the whole speed range. The actual value of a, b and c are pre-set as a function of the application context: c must be set to accept the lateral acceleration measured at stop in all curves; b is set using measured values to accept expected ride accelerations and reject accelerations caused by faults; a is set using measured values, depends on track quality and is set to avoid false alarms when riding on a straight line or in a zero cant deficiency curve.

The values of SP1 and SP2 are also pre-set in the same way: SP1 is the speed over which tilting is performed. SP2 is a speed used to reach progressively the maximum tilting compensation. These values are usually selected by railway authorities based on track geometry and car limitations.

TABLE 1

Limit Line Selection Table

| Tilting Command Amplitude S11 | Lateral Acceleration Polarity S7 | Polarity Check Flag S8 | Limit Line |
|---|---|---|---|
| >=1° | +1 | +1 | T2 |
| >=1° | +1 | −1 | T1 |
| >=1° | −1 | −1 | T4 |
| >=1° | −1 | +1 | T3 |
| <1° | +1 | — | T1 |
| <1° | −1 | — | T4 |

When tilting command amplitude S11 is below 1°, the limit line is always T1 or T4 (more permissive). The reason for this exception is that when a train goes through a curve with low cant deficiency, it is possible to encounter momentary situations where the polarity check flag 85 will be positive.

As will be evident to one skilled in the art, the limit angle of the tilting command amplitude S11 can be set to another value without changing the essence of the invention. For example, if in a particular system, 2° seems to be more representative of the limit, the angle value can be changed.

Such situations include the case where high cant curves are taken at low speed: in this case, the lateral acceleration S4' can have a relatively large value, because of the gravity component it measures. At low speed, the tilting command is low or zero. If the polarity of the command S3 is the same as the acceleration S4', limit line T2 or T3 will not be chosen as limit lines. This avoids false alarms.

Threshold function 93 produces the lateral acceleration limit S9, to which the lateral acceleration S4' is compared in second comparator 94, resulting in a comparison signal S10, whose value is "below limit" or "above limit". The persistency check 95, outputs an alarm S5 if the comparison signal S10 has the "above limit" value for more than a preset delay.

The following failure cases are covered by this mechanism:

1. Tilting on wrong side (inverse tilt): the tilting command S3 and the lateral acceleration S4' have the same polarity a or −a is chosen as limit value.
2. Tilting on a tangent track segment: similar to case 1; tilting command S3 and lateral acceleration S4' have the same polarity.
3. No or not enough tilting in a curve requiring tilting: the tilting command S3 is insufficient. In this case the limit value will vary between c and b or −c and −b, depending on the speed value.

Note that the acceptable limit for lateral acceleration is more restrictive for cases 1 and 2 than for case 3. This is because a certain amount of residual lateral acceleration is always expected when a tilting train goes through a curve (see FIG. 5). On the other hand, the presence of residual lateral acceleration on tangent track is not physically consistent, and therefore this situation is less tolerated. The same reasoning applies to wrong side tilting.

In another embodiment of the invention, the limit lines could be replaced by a decision equation. Substituting the values for the tilting command, the lateral acceleration, the speed and their respective polarities in an equation with specific weights would yield a decision for the alarm.

In another embodiment of the invention, the limit on the lateral acceleration could be fixed at all times. The analysis of the malfunctions would be less efficient but would have a fixed delay. Another modification would be to monitor a subset of the signals, instead all three signals: lateral acceleration, speed and tilting command.

In yet another embodiment of the invention, the lateral acceleration could be obtained from another element of the trainset.

In another embodiment of the invention, a feedback loop to the master controller from the monitoring unit could be used. This loop would permit the master controller to know that an alarm has been raised. Using this information, the master controller could try to change some of its parameters to correct the error or enable the shutting down of the system. The master controller could, for example, allow a longer delay for the filtering of the signals of one passenger car or could modify the reference values used to calculate the tilting command to take into account the error associated with a particular sensor.

What is claimed is:

1. A method for monitoring performance of a train tilting system, comprising:

sending a tilting command to a passenger car to effectuate tilting thereof;

measuring a lateral acceleration to which passengers in the passenger car are subjected;

generating a lateral acceleration signal;

comparing said lateral acceleration signal to a lateral acceleration limit value; and altering control of said tilting system of the passenger car as a result of said comparison.

2. The method of claim 1, wherein altering control of said tilting system comprises re-centering said passenger car and disabling said tilting system.

3. The method of claim 2, wherein disabling said tilting system comprises lighting up an indicator.

4. The method of claim 2, wherein the train includes a plurality of passenger cars and disabling said tilting system is done separately on each passenger car.

5. The method of claim 1, wherein comparing said lateral acceleration signal to said lateral acceleration limit value is done on a car-to-car basis.

6. The method of claim 1, further comprising:

determining said lateral acceleration limit value based on a speed for said passenger car and the tilting command for said tilting system of said passenger car, wherein said determining comprises comparing a polarity of said lateral acceleration signal and a polarity of the tilting command to output a polarity check flag; and selecting said lateral acceleration limit value using said polarity check flag, an absolute value of the tilting command, a train speed signal and said polarity of lateral acceleration signal.

7. The method of claim 6, wherein selecting said lateral acceleration limit value comprises:

choosing a first value if the tilting command amplitude is smaller than a threshold value and the polarity of said lateral acceleration signal is positive;

choosing a second value if the tilting command amplitude is smaller than a threshold value and the polarity of said lateral acceleration signal is negative;

choosing a third value if the tilting command amplitude is greater than or equal to a threshold value, the polarity of said lateral acceleration signal is positive and said polarity check flag is positive;

choosing a fourth value if the tilting command amplitude is greater than or equal to a threshold value, the polarity of said lateral acceleration signal is positive and said polarity check flag is negative;

choosing a fifth value if the tilting command amplitude is greater than or equal to a threshold value, the polarity of said lateral acceleration signal is negative and said polarity check flag is positive; and choosing a sixth value if the tilting command amplitude is greater than or equal to a threshold value, the polarity of said lateral acceleration signal is negative and said polarity check flag is negative.

8. The method of claim 7, wherein the lateral acceleration limit value is a function of speed.

9. The method of claim 8, wherein said lateral acceleration limit value is constant from a startup speed to a first speed, varies linearly with respect to the speed from a first speed to a second speed and is constant from a second speed.

10. The method of claim 9, wherein said lateral acceleration limit value is constant for all speeds.

11. The method of claim 7, wherein said threshold value for the tilting command amplitude is between approximately 0.5° to 3°.

12. The method of claim 7, wherein the lateral acceleration limit value is chosen using a table.

13. The method of claim 7, wherein said first value of the lateral acceleration limit value and said fourth value are the same.

14. The method of claim 7, wherein said second value of the lateral acceleration limit value and said sixth value are the same.

15. The method of claim 7, wherein said threshold value for the tilting command amplitude is approximately 1°.

16. The method of claim 6, wherein the lateral acceleration limit value is a function of speed.

17. The method of claim 6, wherein selecting said lateral acceleration limit value comprises solving a decision equation using said speed, said lateral acceleration signal and said tilting command.

18. The method of claim 6, further comprising altering control of said tilting system when said lateral acceleration is greater than said lateral acceleration limit value for a predetermined delay.

19. The method of claim 1, wherein said lateral acceleration is measured by an accelerometer on the passenger car body.

20. The method of claim 1, wherein:

the lateral acceleration limit value is fixed.

21. The method of claim 20, further comprising:

determining said acceptable lateral acceleration limit value based on a speed for said passenger car and the tilting command for said tilting system of said passenger car.

22. The method of claim 1, wherein:

the lateral acceleration limit value is variable.

23. The method of claim 22, further comprising:

determining said acceptable lateral acceleration limit value based on a speed for said passenger car and the tilting command for said tilting system of said passenger car.

24. The method of claim 1, wherein:

the lateral acceleration limit value corresponds to an acceptable level of lateral acceleration.

25. A system for monitoring performance of a train tilting system, comprising:

a controller generating a tilting command signal for a passenger car of a train;

a lateral acceleration sensor detecting a lateral acceleration felt at a passenger level on the passenger car and outputting a lateral acceleration signal; and a comparator receiving said lateral acceleration signal and a lateral acceleration limit signal and generating a control signal output.

26. The system of claim 25, further comprising a lateral acceleration limit value generator receiving at least one of speed, lateral acceleration and tilting command and generating said lateral acceleration limit signal.

27. The system of claim 26, wherein the lateral acceleration limit value is calculated as a function of a speed value, polarity of lateral acceleration signal, amplitude and polarity of tilting command.

28. The system of claim 25, wherein said train has multiple passenger cars and further comprises:

a tilt controller altering control of said tilting system for each passenger car based on said control signal output.

29. The system of claim 25, wherein said train has multiple passenger cars and further comprises:

multiple tilt controllers altering control of said tilting system for each passenger car based on said control signal output.

30. The system of claim 20, wherein said comparator alters the control of said tilting system if the lateral acceleration signal is greater than the lateral acceleration limit signal for a predetermined delay.

31. A system for monitoring performance of a train tilting system, comprising:

a first polarity detector that detects a polarity of a lateral acceleration of a passenger car, a second polarity detector that detects a polarity of a tilting command for a passenger car, an absolute value detector that detects an absolute value of said tilting command, a first comparator that compares said polarity of the lateral acceleration and said polarity of the tilting command and outputting a polarity check flag, a threshold function that computes a limit value for the lateral acceleration using said polarity of the lateral acceleration, said polarity check flag, said absolute value of the tilting command and a speed of said passenger car and outputs said limit, a second comparator that compares said limit value to said lateral acceleration, and a persistency check that alters the control of said tilting system if said lateral acceleration is greater than said limit value for a period of time longer than a predetermined delay.

32. The system of claim 31, further comprising an indicator responsive to said persistency check.

33. The system of claim 32, wherein said indicator is located in a conductor cab.

34. The system of claim 32, wherein said indicator automatically shuts down the tilting system.

35. The system of claim 31, wherein:

said second comparator generates a comparison signal selected from at least one of below limit and above limit, and said persistency check alters the control of said tilting system if said comparison signal is above limit for a period of time longer than a predetermined delay.

* * * * *